US005529629A

United States Patent [19]

Beisswanger

[11] Patent Number: 5,529,629

[45] Date of Patent: Jun. 25, 1996

[54] APPLICATOR SYSTEM FOR APPLICATION OF COLOR COATING ON A PAPER WEB

[75] Inventor: Rudolf Beisswanger, Steinheim, Germany

[73] Assignee: J. M. Voith GmbH, Heidenheim, Germany

[21] Appl. No.: 287,094

[22] Filed: Aug. 8, 1994

Related U.S. Application Data

[63] Continuation of Ser. No. 62,605, May 17, 1993, abandoned.

[30] Foreign Application Priority Data

May 19, 1992 [DE] Germany ..... 42 16 447.8

[51] Int. Cl.[6] ..... B05C 11/10

[52] U.S. Cl. ..... 118/665; 118/411; 118/429; 118/600; 118/710; 118/712

[58] Field of Search ..... 118/665, 710, 118/712, 600, 249, 259, 410, 411, 419, 429, DIG. 3

[56] References Cited

U.S. PATENT DOCUMENTS

| | | | |
|---|---|---|---|
| 3,190,261 | 6/1965 | Ziffer | 118/665 |
| 3,567,923 | 3/1971 | Hutchison | 118/665 |
| 4,546,624 | 10/1985 | von der Eltz et al. | 118/429 |
| 4,627,989 | 12/1986 | Feuerstein et al. | 118/665 |
| 4,732,776 | 3/1988 | Boissevain | 417/10 |
| 4,957,770 | 9/1990 | Howarth | 427/9 |
| 5,045,342 | 9/1991 | Boissevain et al. | 118/665 |

FOREIGN PATENT DOCUMENTS

| | | |
|---|---|---|
| 1652474 | 2/1971 | Germany . |
| 3203087 | 8/1983 | Germany . |
| 3605409 | 8/1987 | Germany . |
| 3604409 | 8/1987 | Germany . |
| 3637452 | 5/1988 | Germany . |
| 4013322 | 10/1991 | Germany . |

OTHER PUBLICATIONS

Abstract Bulletin of the Institute of Paper Chemistry, vol. 53, No. 4, Oct. 1982.

Cumbustion Engineering Brochure No. 3115C, "AccuRay 1180 MicroPlus, Microscan Basis Weight Sensor (Promethium)", 1988.

Cumbustion Engineering Brochure No. 3118, "AccuRay 1180 MicroPlus, Microscan Measurement Platform", 1988.

*Primary Examiner*—Jill Warden
*Assistant Examiner*—Jan M. Ludlow
*Attorney, Agent, or Firm*—Baker & Daniels

[57] ABSTRACT

An applicator system for applying color coating on a paper web is disclosed having a color coating applicator along with a backing roll around which is wrapped the paper web. A measuring system is incorporated for measuring a predetermined property of the color coating at several points along the width of the paper web. Predetermined qualities of the color coating include weight, thickness, or surface properties of the coated surface. A control means is included for controlling the color coating arriving at the application zone. The color coating is controlled by varying the temperature, or the consistency of the color coating in a zonewise fashion across the width of the paper web.

8 Claims, 7 Drawing Sheets

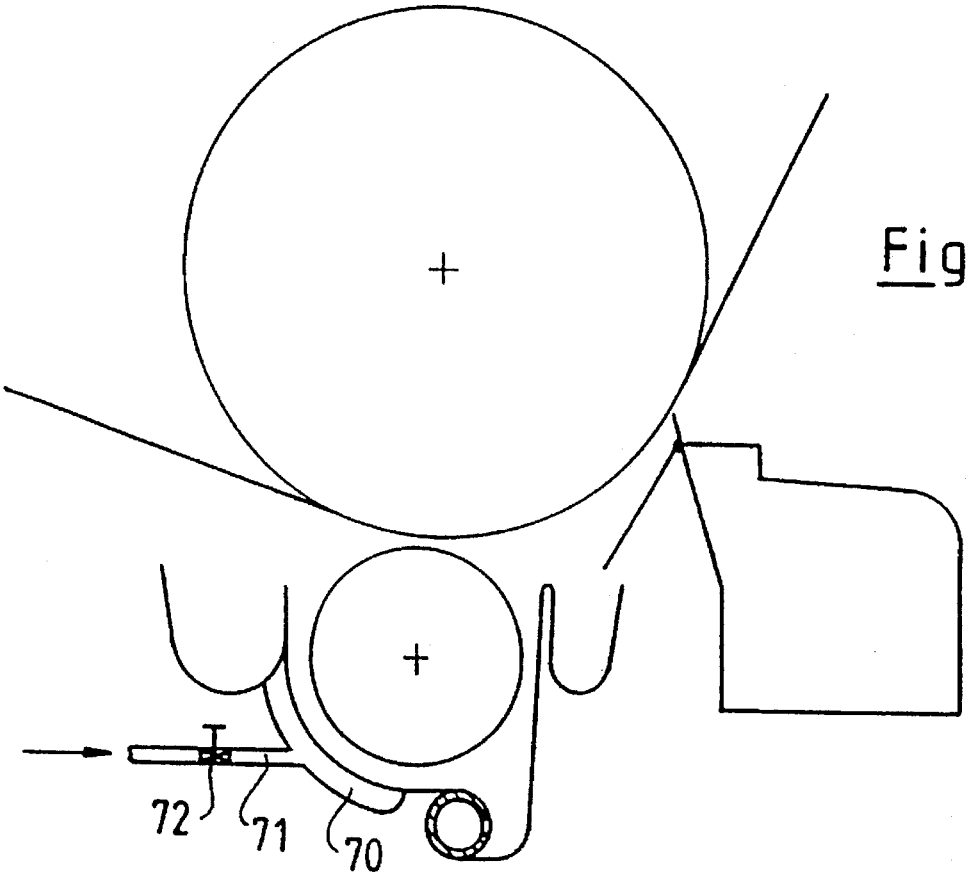
Fig.13
Fig.14
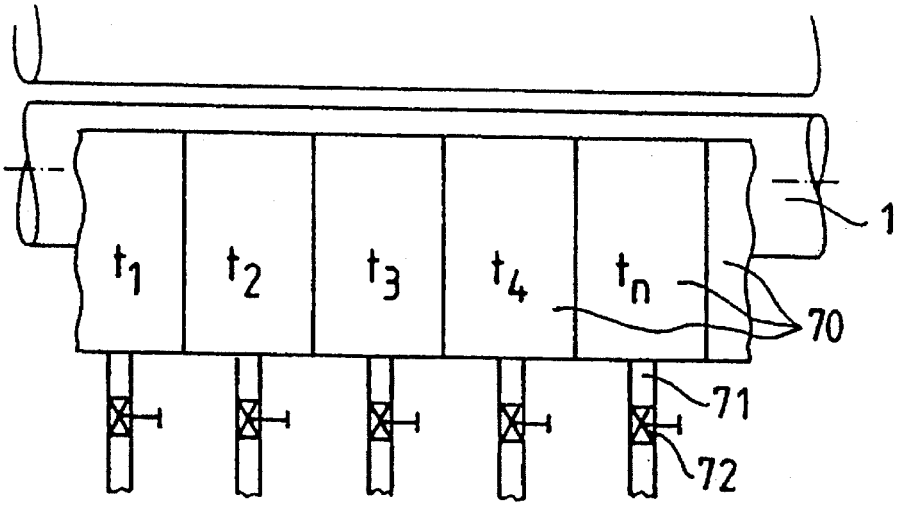

APPLICATOR SYSTEM FOR APPLICATION OF COLOR COATING ON A PAPER WEB

This is a continuation of application Ser. No. 08/062,605, filed May 17, 1993, now abandoned.

BACKGROUND OF THE INVENTION

The invention relates to an applicator system for application of color coating on a paper web. The system may include both roll type and nozzle type applicators.

Roll applicators of this type are known from DE 36 05 409 A1. This device is intended to produce a uniform coating.

The technical requirements for coating systems, more generally, are always the following: the coating is to be applied on the paper web uniformly in any respect, and at that, both in cross direction (cross profile) and also in longitudinal direction. The primary concern is the coating weight, but also other properties such as the outer appearance of the coating surface.

The disturbance factors opposing these requirements are numerous. With roll type applicator systems, problems occur most of all in the wedge-shaped entrance zone between applicator roll and backing roll, and at that, especially at high velocities. This is attributable most of all to the effect of the air which in the rotation of the backing roll is carried into the entrance bore together with the paper web. The air mixes with the color coating at the point where the latter makes contact with the paper web. Generally, an overflow of color coating occurs at the upper edge of the machinewide guide assembly, and at that, opposite to the direction of travel of the paper web and opposite to the airflow. If the airflow impinges on this overflow, the result is a partial backup of the overflow as well as a mixing of air and color coating. Disturbances of that type occur also in the absence of a guide assembly, when as a consequence an unimpeded level of coating mixture adjusts itself between the shell surface of the applicator roll and the wall of the trough.

Another disturbance factor may be constituted by an irregular supply of color coating to the application zone. These irregularities may have various causes, for instance manufacturing inaccuracies of the participating components, shortcomings in the design geometry or flow geometry, or hydrodynamic disturbance problems, and thus undesirable variations of the dimensions of the flow channels in which the color coating flows.

A third category of disturbance factors resides in the base paper. As is generally known, the base paper involves fluctuations of the basis weight, roughness and absorption performance, and at that, both across the web width and also in the travel direction of the web, and thus over time. These factors are particularly difficult to manage.

As known, doctor systems are located at the end of the usual roll type applicators. These systems comprise a doctor blade, which can be set at the paper web bearing on the backing roll, and a doctor beam supporting the blade. In the event of coating irregularities, corrections are attempted by means of the doctor system. In doing so, an adjustment can be effected across the entire width. But locally limited corrections can also be made, that is, only at certain points of the web width. These measures may provide a certain remedy, but mostly they are insufficient to achieve the desired result.

The problem underlying the invention is to design an applicator system in such a way that the coating may in any respect be produced more uniformly than was the case previously.

SUMMARY OF THE INVENTION

The present invention overcomes the problems and disadvantages of the above described prior art systems by including a control means for controlling the color coating by measuring a predetermined quality of the color coating at several points along the width of the paper to be coated and then controlling the applied color coating in a zonewise fashion across the width of the paper. The basic idea of the invention consists in performing a zonewise influencing of the coating, or of its properties, by means located at a certain distance before the application zone. The means operate zonewise—i.e., across broad sections of the machine—to influence particular qualities of the color coating either the throughput of color coating or its temperature or its consistency or viscosity.

With prior applicator systems, measures were always directed at influencing the disturbance factors themselves, and thus the coating. The inventor now has chosen an entirely different avenue: he is not concerned with the disturbance factors themselves. He rather utilizes the measuring data of the finished coating in order to exert by the said measures—changes of throughput, temperature or consistency—an influence at a much earlier point. This principle has proved to be an elegant, cost-saving and effective way to compensate for the disturbance factors.

There are many options in reducing the invention to practice. For example, the flow channel formed between the applicator roll and the guide wall may at a specific point of the flow path feature a plurality of valves arranged side by side across the channel width, for instance in the form of constrictors. A zonewise influencing of the throughput in the channel then takes place by appropriate actuation of one or several of these valves. Furthermore, it would be conceivable to provide again at a specific point in the flow path a plurality of outlets. Opening or closing one or several of these outlets changes the color coating throughput across a specific zone. Additionally, instead of the outlets, feed lines could be provided which are adjustable by the valves and which—again at a specific point in the flow path—empty into the channel, distributed across its width.

Instead of the measures influencing the throughput, it is according to the invention, also possible to influence the temperature. To that end, a number of heating elements can be arranged, distributed across the width of the machine. They may be arranged either in the flow channel between the applicator roll and the guide wall or within the (hollow) applicator roll, or at any other point in the wall of the trough holding the color coating sump.

Lastly, a number of feed lines can be provided which—again distributed across the width—are able to supply dilutants for the color coating.

All of the above measures are applied in accordance with the result of the data measured on the finished coating. These measuring data thus serve as measuring signals which are entered in a CPU, which issues the instruction to the respective correction unit, for instance, in the case of consistency control, to selected dilutant feed lines.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein:

FIG. 13 is a ninth embodiment of a roll applicator system in side elevation;

FIG. 14 is a detail of the object of FIG. 1, viewed in the direction of arrow A.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
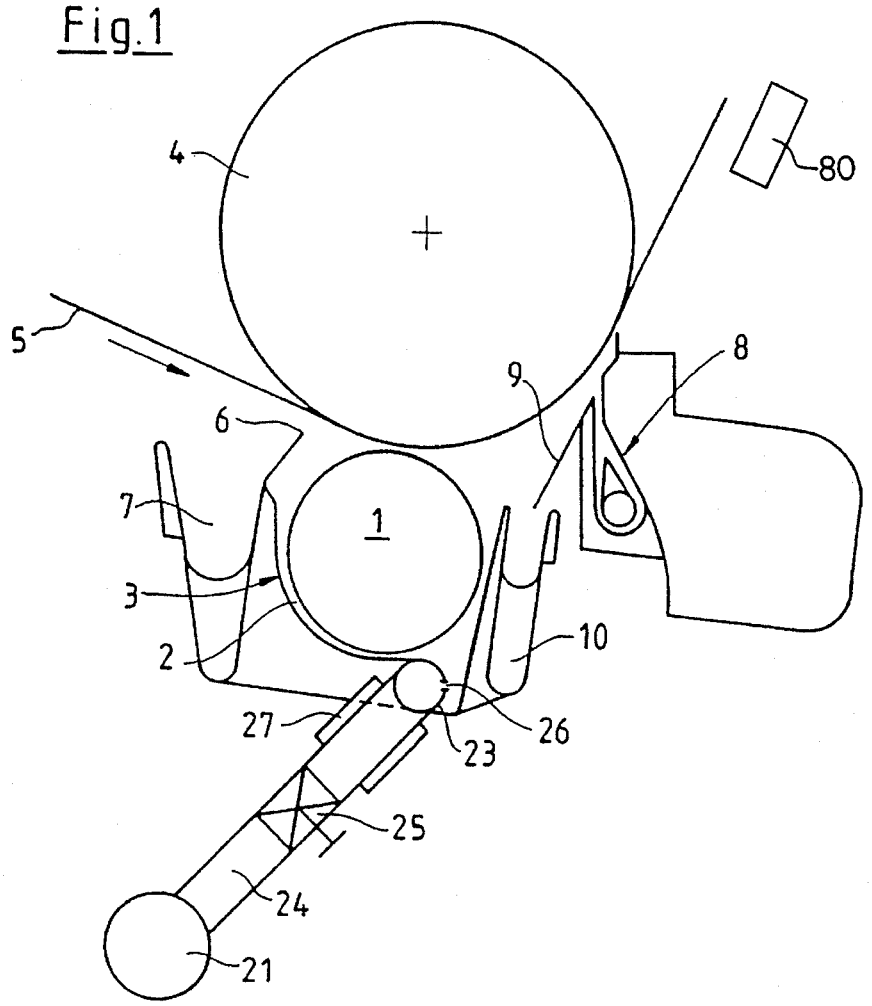
FIG. 1 is a side elevation of a roll applicator system.

The roll applicator system illustrated in FIG. 1 features an applicator roll 1 rotating in a color coating sump 2 contained in a trough 3. Visible, additionally, is a backing roll 4 around which loops a paper web 5. The trough 3 features an overflow edge 6, across which a first overflow —opposite to the direction of travel of the paper web 5—can flow into a first overflow chute 7, where the overflow is removed.

Moreover, there is a nozzle applicator system 8 which follows the roll applicator system. Thus another embodiment is a combined roll-nozzle applicator system. A deflector plate 9 guides a second overflow—coming from the nozzle applicator system—into a second overflow chute 10.

Figure 2:
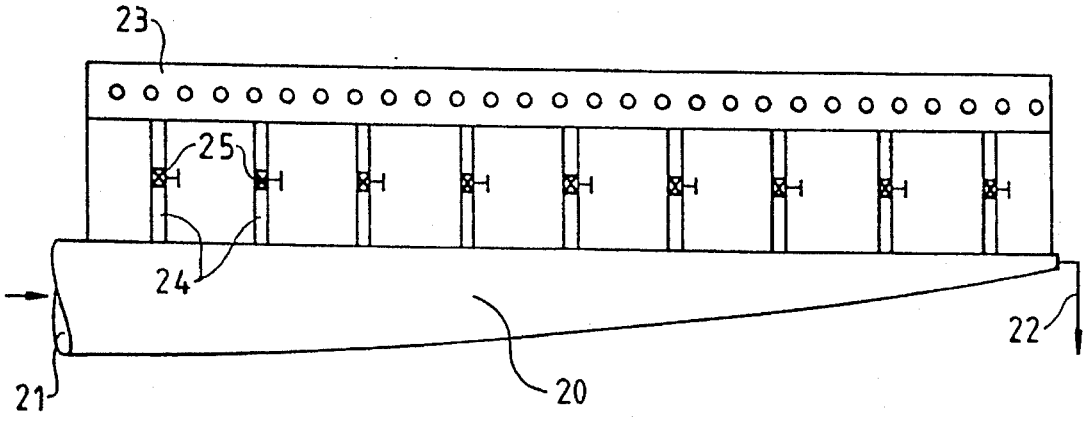
FIG. 2 is a detail of the object of FIG. 1, and at that, in the direction of view of arrow A.

The elements decisive for the invention are embodied in the distributing system. They are visible particularly well in FIG. 2. The distributing system comprises first a conical distribution pipe 20 featuring on its one end an inlet 21 and on its other end an outlet 22. Arranged essentially parallel to the distribution pipe 20 is a feed pipe 23. Feed pipe 23 connects via a number or connecting lines 24 to the distribution pipe 20. The connecting lines 24 feature valves 25. The feed pipe 23 borders on the color coating sump 2 and communicates with it through discharge bores 26.

Decisive in the sense of the invention in this embodiment is the design of the distribution system. Visible in FIG. 1, in the upper area of the connecting lines 24, are electrical heating rods 27, that are coordinated with each individual connecting line. These heating rods can be activated separately, so at least one connecting line or several of these connecting lines 24 can be heated. The heating depends on the result of the measuring system 80, which follows the entire applicator system and which, expressed more generally, captures the quality or a property of the coating (coating profile measurement).

Instead of using heating rods 27 it is also possible to encase the individual connecting lines 24, so each is surrounded by a chamber to which hot water or steam may be fed.

Figure 3:
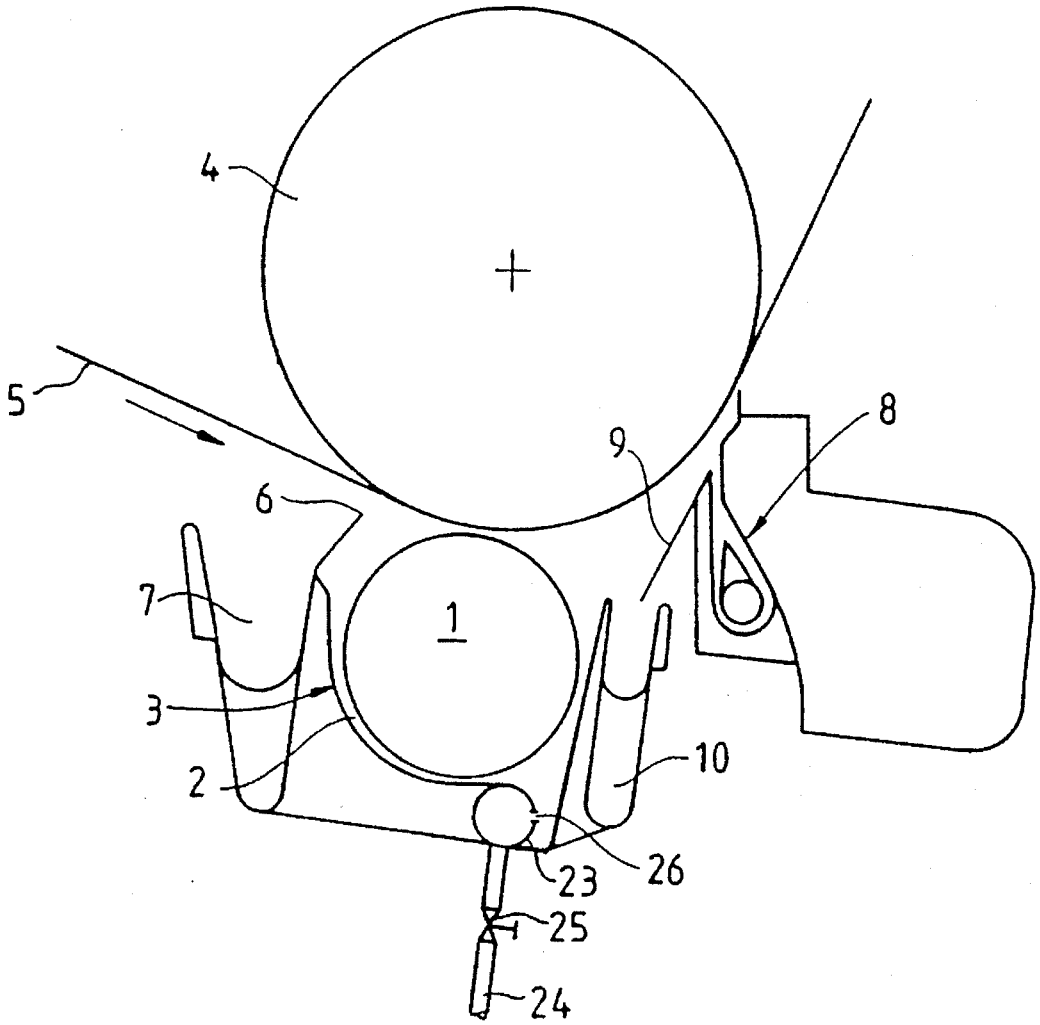
FIG. 3 is a second embodiment of a roll applicator system, again in side elevation.

In the embodiment according to FIG. 3—showing again a combined roll-nozzle applicator system—the feed pipe 23 is fashioned as a cylindrical or conical pipe. It assumes thus simultaneously the function of the distribution pipe 20 in the embodiment according to FIG. 1 and 2. This feed pipe 23 receives in this embodiment on the one end a color coating of "nominal composition." The color coating discharges through discharge bores 26 and thus proceeds into the sump 2 contained in the trough 3. As the case may be, any surplus issues out of the other end of the feed pipe 23, controlled again by a valve.

Unique on this embodiment is that the feed pipe 23 may be supplied, through a number of lines 24 featuring valves 25, with a color coating or dilutant of a different composition or different consistency or different viscosity or temperature other than that of the color coating, which in "nominal composition" is supplied to the distribution pipe 23 on its end. Also thereby, of course, a zonewise influence can be exerted on the coating quality, thus achieving a coating profile control.

Figure 4:
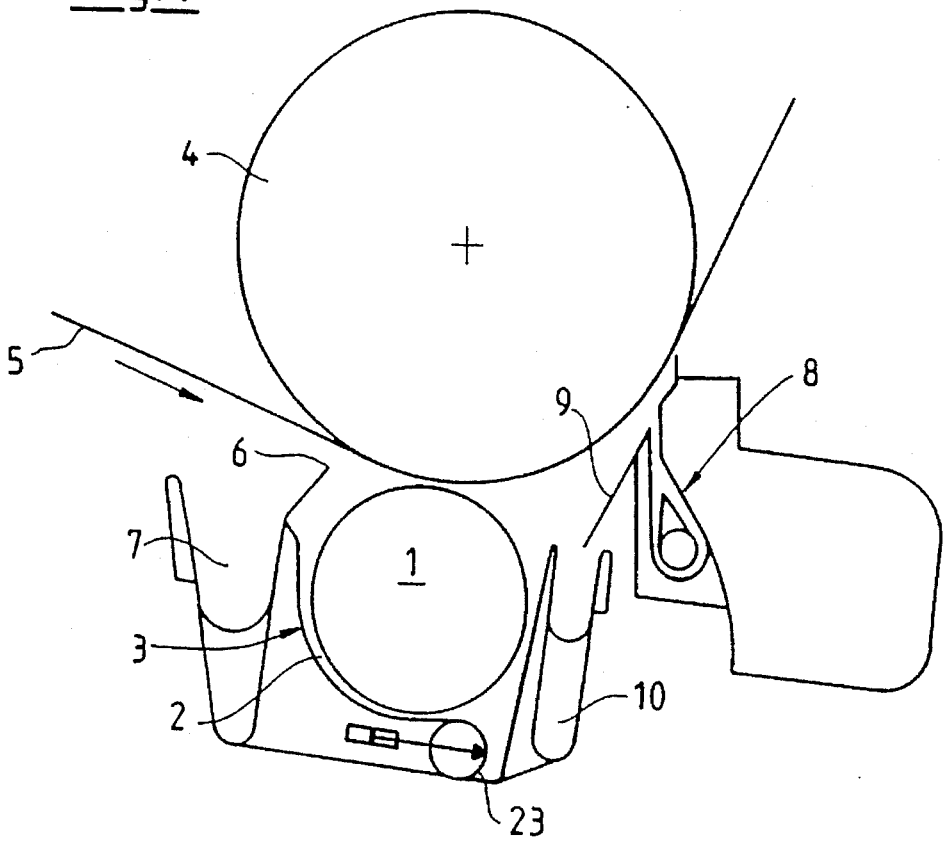
FIG. 4 is a third embodiment of a roll applicator system, again in side elevation.
Figure 5:
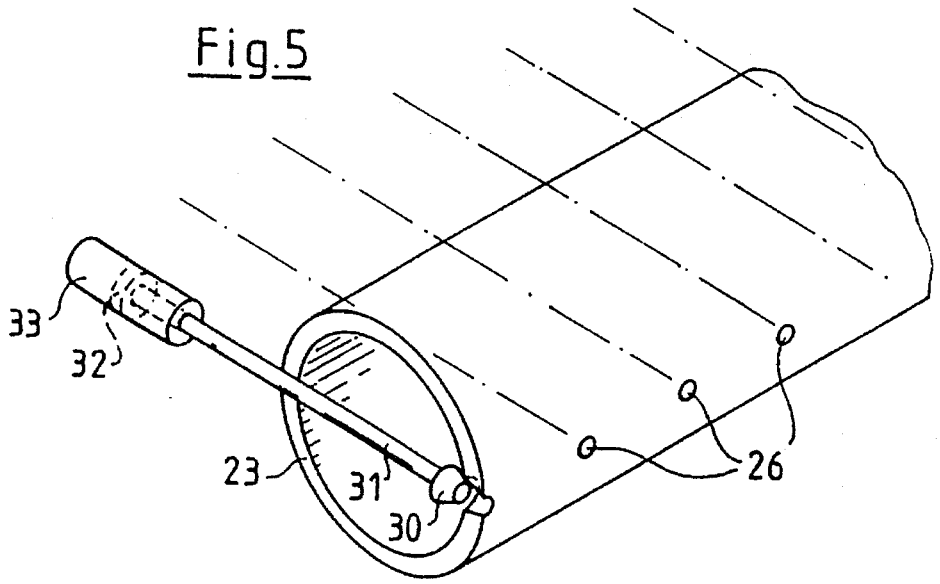
FIG. 5 is a perspective illustration of a detail of the object of FIG. 4.

In the embodiment according to FIGS. 4 and 5, the feed pipe 23 is again provided with discharge bores 26 which empty into the sump 2.

Decisive here is that in the sense of the invention, a zonewise control can be performed by adjusting the flow cross section of the discharge bore 26, such as by means of valves. Illustrated in FIG. 5 is a valve assembly 30 which interacts with a discharge bore 26 as a valve seat, additionally a valve tappet 31, a valve piston 32 and a cylinder 33. The piston-cylinder unit can presently be actuated pneumatically. Of course, such regulating valves can be activated also by control motors. This feed pipe 23, too, assumes at the same time the function of the distribution pipe according to FIG. 1. It has on the one end an inlet and on the other end a controlled outlet. It may be both cylindrical and conical.

Figure 6:
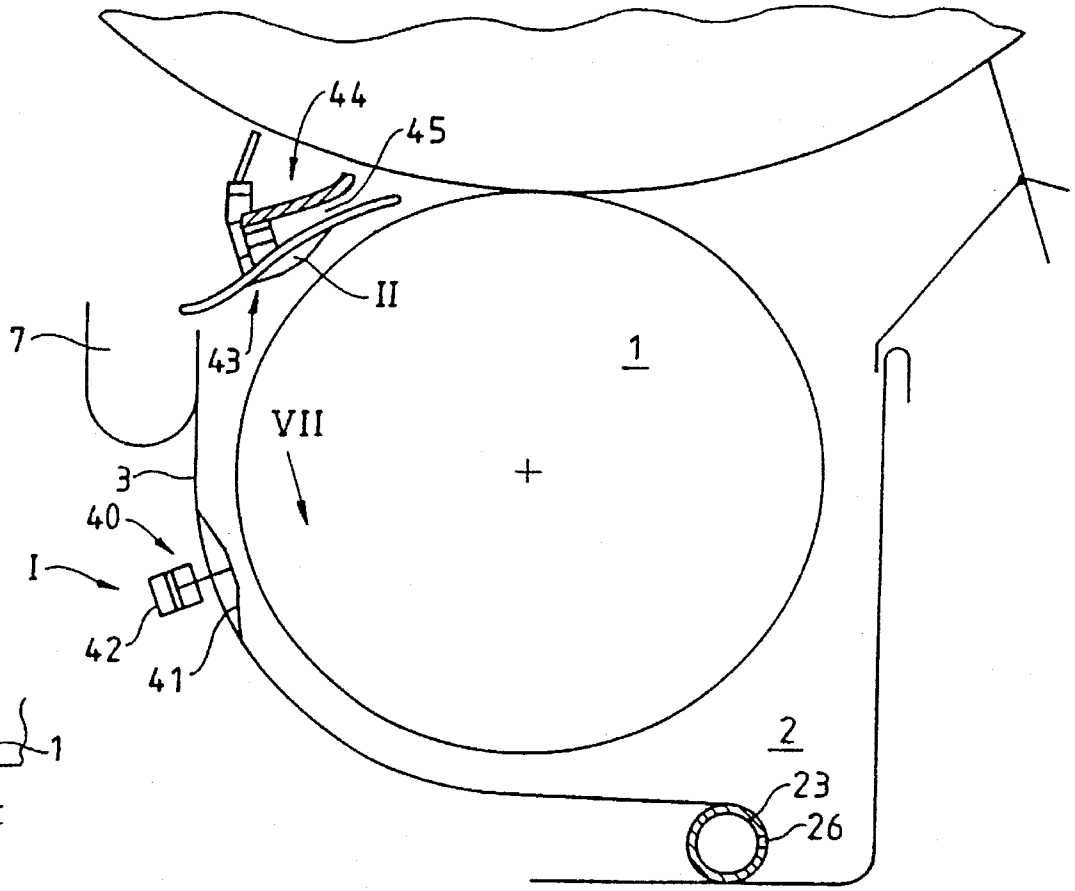
FIG. 6 is a fourth embodiment of a roll applicator system, again in side elevation.
Figure 7:
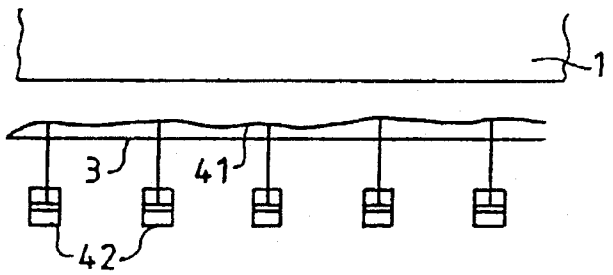
FIG. 7 is a detail of the object of FIG. 6, and at that, as a plan view in the direction of arrow A.

The embodiment according to FIGS. 6 and 7 shows another peculiarity. Visible at the point I, in the flow path of the color coating between the applicator roll 1 and the wall of the trough 3, is a constrictor 40, which is only one of many which—as viewed in the axial direction of the applicator roll—are arranged successively. The constrictor features a bellows 41 which can be pushed or rolled into the flow path, thereby reducing the available flow cross section. A pneumatic unit 42 may again provide the drive.

A quite analogous system 43 may be provided at the point II. This arrangement is especially favorable, since thereby a guide assembly 44 is simultaneously utilized which forms a controlled flow channel 45 for a controlled overflow to a first overflow chute 7. It is understood that the constrictors 40, 44 may be provided either by themselves or separately.

Figure 8:
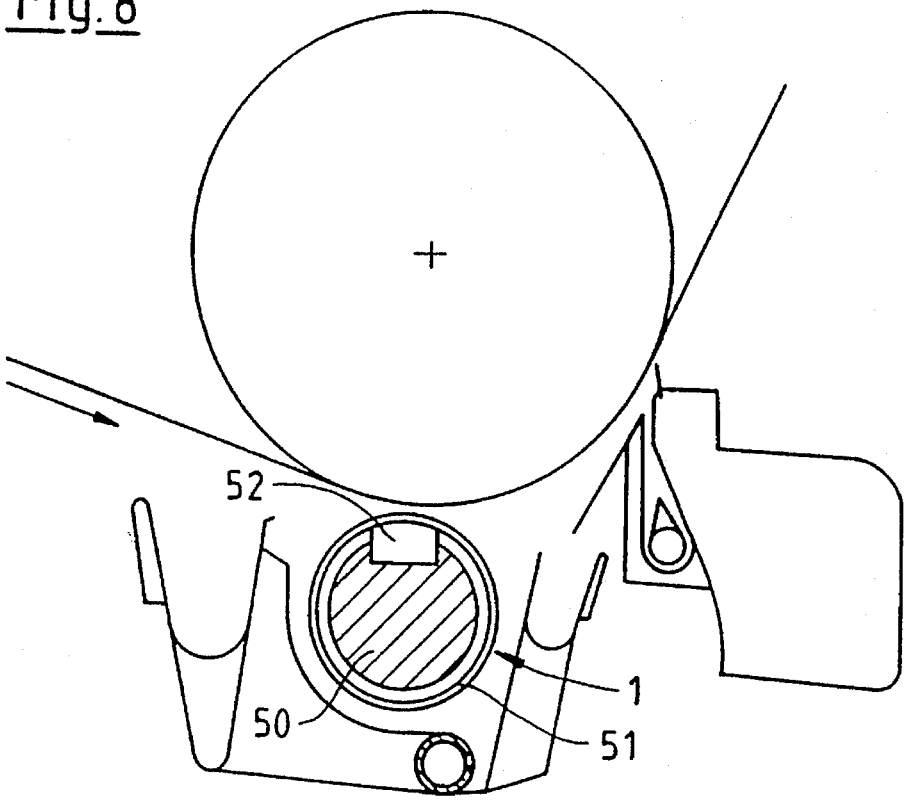
FIG. 8 is a fifth embodiment of a roll applicator system in side elevation.

In the embodiment according to FIG. 8, the applicator roll is fashioned after a flexure compensator roll. Here, the applicator roll 1 comprises a stationary yoke 50, a rotating shell 51 which is essentially concentric to it, as well as a number of plungers 52 which in controlled fashion produce a bearing between the yoke 50 and the shell 51. With this setup, zonewise corrections of the coating result can be achieved as well, depending on which plungers are activated.

Figure 9:
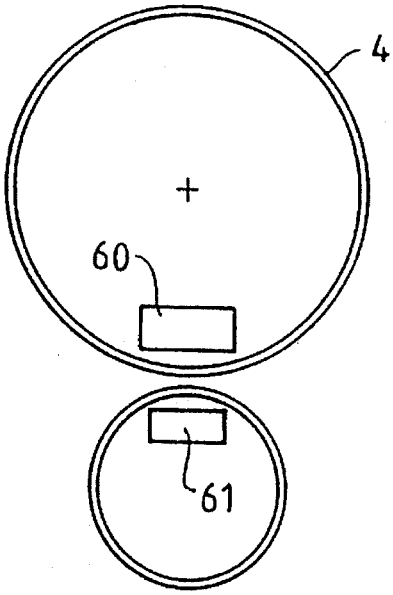
FIG. 9 is a sixth embodiment of a roll applicator system in side elevation.
Figure 10:
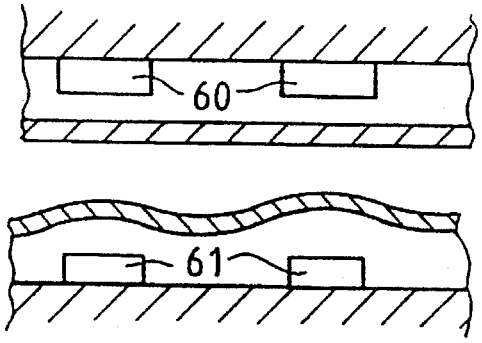
FIG. 10 is a section of the object of FIG. 9, but viewed in axial section.

The embodiment according to FIGS. 9 and 10 approaches the problem essentially at the same place as that according to FIG. 8. But here, activatable magnetic field systems serve the exertion of thrust forces and, thus, the deformation of the roll shell 51. FIG. 10 depicts permanent magnets 60 arranged on the backing roll 4, as well as soft iron cores 61 with coils coordinated with the applicator roll 1. This embodiment compared to the one relative to FIG. 8, has the advantage of being simpler and less expensive in design and that the adjustment of the application gap can be carried out more sensitively.

Figure 11:
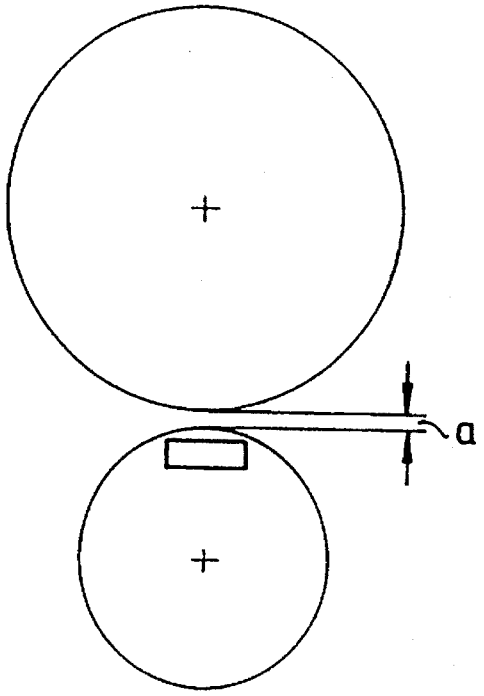
FIG. 11 is a seventh embodiment of a roll applicator system in side elevation.

A quite significant embodiment is illustrated in FIG. 11. Here, the distance a is electrothermally varied zonewise with the aid of induction coils 70. The advantage of this embodiment is that, by means of the induction coils, the spacing can be held extremely close, namely at values of less than 100 mm. Additionally, the induction current allows an extremely sensitive control, making the zonewise control precise and reproducible.

This principle also can be provided anywhere in the flow path of the color coating. Thus, the induction coils may serve to adjust the channel width between the applicator roll 1 and the trough 3 for example.

Figure 12:
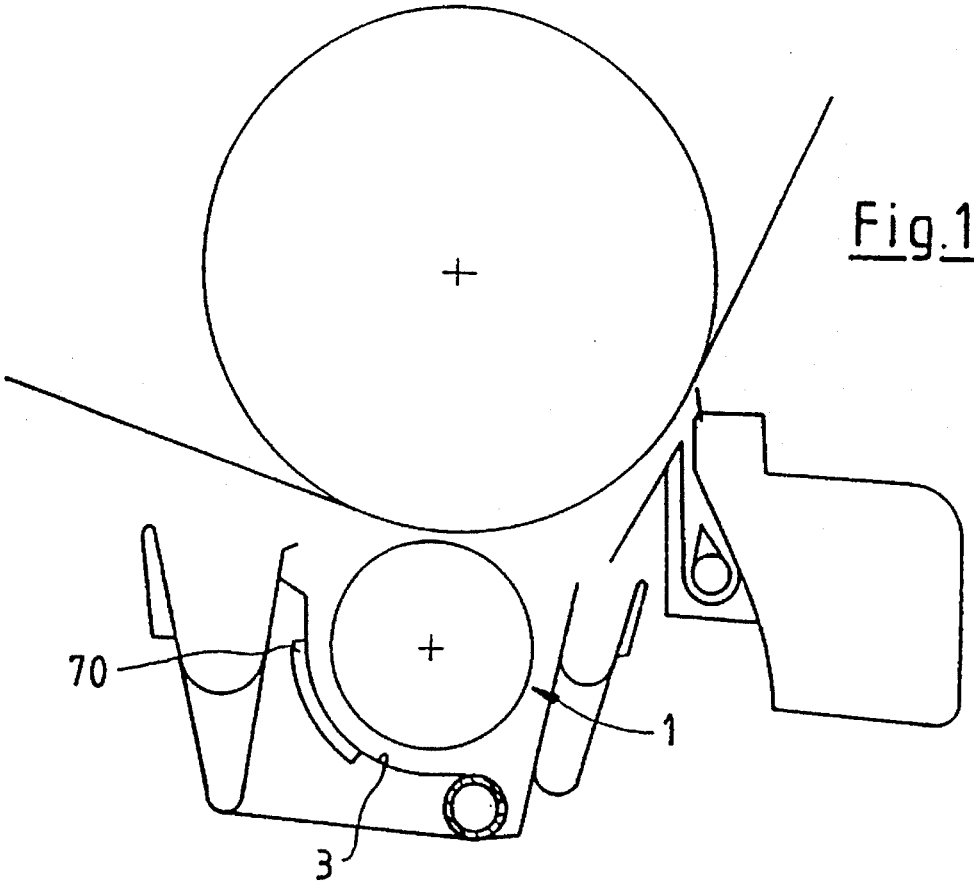
FIG. 12 is an eighth embodiment of a roll applicator system in side elevation.

In the embodiment according to FIG. 12, the zone control is again effected by means of temperature. Here, the trough 3 is heated zonewise as viewed in the axial direction of the applicator roll 1, but may be heated differently as the case may be. The heating may be performed with electrical heating rods, by hot water, steam, by inductions coils or other means.

In the embodiment according to FIG. 13 and 14, the steam heating concept is illustrated in more detail. Visible in the side elevation according to FIG. 13 is a chamber 70 featuring a steam socket 71 with a valve 72. FIG. 14 shows a number of chambers 70 are included in this embodiment.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An applicator system for application of color coating on a paper web, said system comprising:

an applicator for applying color coating to a paper web;

a backing roll around which is wrapped the paper web, said backing roll and said applicator together forming an application zone therebetween;

a measuring system for measuring a predetermined property of the color coating at several points along the width of the paper web downstream from the application zone; and control means for controlling the color coating to be applied to the paper web one of at the application zone or prior to the coating arriving at the application zone, said control means adapted to control the predetermined property of the applied color coating in zonewise fashion across the width of the paper web, said control means influencing the consistency of the color coating by introduction of an additional medium to the color coating.

2. The applicator system of claim 1 further comprising a trough forming a color coating sump, said trough having a color coating inlet, a guide wall equipped with a first overflow edge; and an overflow chute attached to said first overflow edge for a first overflow, said applicator being an applicator roll rotatable in said color coating sump.

3. The applicator system of claim 1 in which said applicator includes an applicator roll and an applicator nozzle, said applicator roll parallel to said backing roll, said paper web located between said applicator roll and said backing roll, said applicator nozzle extending across the width of the paper web.

4. The applicator system of claim 3 in which said applicator roll precedes said applicator nozzle in the direction of paper web travel.

5. The applicator system of claim 1 in which said control means comprises a plurality of controllable feed lines for supplying mediums to the color coating in a zonewise fashion across the backing roll width that change the predetermined property of the color coating.

6. The applicator system of claim 2 in which said control means comprises a plurality of controllable feed lines for supplying mediums to the color coating in a zonewise fashion across the backing roll width that change the predetermined property of the color coating.

7. The applicator system of claim 3 in which said control means comprises a plurality of controllable feed lines for supplying mediums to the color coating in a zonewise fashion across the backing roll width that change the predetermined property of the color coating.

8. The applicator system of claim 4 in which said control means comprises a plurality of controllable feed lines for supplying mediums to the color coating in a zonewise fashion across the backing roll width that change the predetermined property of the color coating.

* * * * *